US009532686B1

(12) United States Patent
Heiss

(10) Patent No.: US 9,532,686 B1
(45) Date of Patent: Jan. 3, 2017

(54) TOILET LID AND SEAT SYSTEM AND METHODS OF USE

(71) Applicant: James Donald Heiss, Raleigh, NC (US)

(72) Inventor: James Donald Heiss, Raleigh, NC (US)

( * ) Notice: Subject to any disclaimer, the term of this patent is extended or adjusted under 35 U.S.C. 154(b) by 0 days.

(21) Appl. No.: 15/215,835

(22) Filed: Jul. 21, 2016

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/234, 246.1–246.5
See application file for complete search history.

(56) References Cited

U.S. PATENT DOCUMENTS 4,995,120 A 2/1991 Tager
5,867,843 A * 2/1999 Robello ..... A47K 13/10 4/246.1
6,941,588 B1 * 9/2005 Oprandi ..... A47K 13/10 4/246.1
9,044,122 B2 * 6/2015 Corbell ..... A47K 13/10
2010/0299819 A1 * 12/2010 Huang ..... A47K 13/24 4/244.2

* cited by examiner

*Primary Examiner* — Paul R Durand
*Assistant Examiner* — Nicholas Ros
(74) *Attorney, Agent, or Firm* — NK Patent Law, PLLC

(57) ABSTRACT

The toilet system described herein provides a solution for men who fail to close the toilet seat or lid after use. By automatically closing the lid or seat, the toilet system also reduces toilet access to young children and pets. Its dimensions and installation are the same as an industry standard toilet seat but with selectable automatic closure of the seat or lid after use. The power source, electronics and mechanical actuator are all located within the lid. Tilt and position sensors determine the positions of the seat and lid, distance or proximity sensors detect when the toilet is not in use and after a delay the actuator selectively moves the seat or lid to a closed position.

20 Claims, 12 Drawing Sheets

TOILET LID AND SEAT SYSTEM AND METHODS OF USE

TECHNICAL FIELD

The presently disclosed subject matter is directed towards a method and system for closing the seat and/or lid of a toilet. Specifically, when a seat and/or lid is detected in a vertical position and a toilet is determined to not be in use, the seat and/or lid may be pivoted to a horizontal position using an arm extending from the lid.

BACKGROUND

The use of toilets with a pivotable seat and/or lid is ubiquitous. Further, it is well-known that the failure of men to place the toilet seat in a horizontal, closed position after use can become problematic for women sharing the same facilities. Additionally, after any use of a toilet, it is often desirable to have both the seat and the lid in a horizontal position to ensure that pets or small children are limited access to the toilet. While some high-end toilets have automated seat and lid closing functions, a more cost affordable seat and lid capable of automatic closing has not been provided. Further, an automated seat and lid capable of being easily retrofitted to toilets has not been provided.

Accordingly, there remains a need for a system and methods for automatic closure of toilet seat and lids that addresses the various disadvantages associated with previous toilets.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Further, the claimed subject matter is not limited to implementations that solve any or all disadvantages noted in any part of this disclosure.

According to at least one embodiment of the disclosed subject matter, a method for closing a toilet is provided. The method includes a position detector housed within a lid detecting a seat in a vertical position, wherein the seat and the lid are pivotable between the vertical position and the horizontal position about a hinge housed within a base of the toilet; a use detector housed within the lid determining the toilet is not in use; when the seat is detected in the vertical position and the toilet is determined not in use, an actuator positioned within the lid translating an engaging portion of an arm into engagement with a rear edge of the seat for pivoting the seat about the hinge towards the horizontal position.

According to at least one embodiment of the disclosed subject matter, the method further comprises wherein the translation of the arm further involves translating the engaging portion above a ridge defined by the base; the actuator translating the engaging portion of the arm into engagement with a ridge defined by the base of the toilet for pivoting the lid from the vertical position towards the horizontal position.

According to at least one embodiment of the disclosed subject matter, a system for closing a toilet is provided. The system includes the toilet including a base housing a hinge, a lid, a seat defining a rear edge proximal to the base, wherein the seat and the lid are pivotable about the hinge between a vertical position and a horizontal position; a position detector housed within the lid for detecting when the seat is in the vertical position; a use detector housed within the lid for determining when the toilet is not in use; an actuator positioned within the lid for translating an engaging portion of an arm into engagement with the rear edge of the seat for pivoting the seat about the hinge towards the horizontal position.

According to at least one embodiment of the disclosed subject matter, the system further includes the base defining a ridge; wherein the translation of the arm further involves translating the engaging portion above the ridge; and wherein a reverse translation of the arm by the actuator involves the engaging portion engaging a ridge defined by the base of the toilet and pivoting the lid from the vertical position towards the horizontal position.

According to at least one embodiment of the disclosed subject matter, the system and/or method further includes a power source housed within the lid providing power to the actuator, the position detector and the use detector.

According to at least one embodiment of the disclosed subject matter, the system and/or method further includes a power switch positioned on the toilet being placed in an automatic position for enabling the power source to provide power.

According to at least one embodiment of the disclosed subject matter, the system and/or method further includes a component switch positioned on the toilet being placed in a seat position for controlling the translation of the arm such that the engaging portion does not translate above a ridge defined by the base.

According to at least one embodiment of the disclosed subject matter, the system and/or method further includes a component switch positioned on the toilet being placed in a lid position for controlling the translation of the arm such that the engaging portion translates above the ridge defined by the base.

According to at least one embodiment of the disclosed subject matter, the system and/or method further includes wherein the position detector includes a lid tilt sensor determining the lid position and a seat sensor determining when the seat is in the vertical position.

According to at least one embodiment of the disclosed subject matter, the system and/or method further includes wherein the use detector includes a presence sensor detecting the presence of a toilet user or a timer or both.

According to at least one embodiment of the disclosed subject matter, the system and/or method further includes wherein activation of the timer is initiated by the presence sensor or the position detector.

According to at least one embodiment of the disclosed subject matter, the system and/or method further includes wherein: the arm extends from the lid and the engaging portion is positioned proximal the base; the pivoting the seat about the hinge only partially pivots the seat towards the horizontal position; and gravity completes the pivoting of the seat to the horizontal position.

BRIEF DESCRIPTION OF THE DRAWINGS

The foregoing, as well as the following Detailed Description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed.

DETAILED DESCRIPTION

Figure 1:
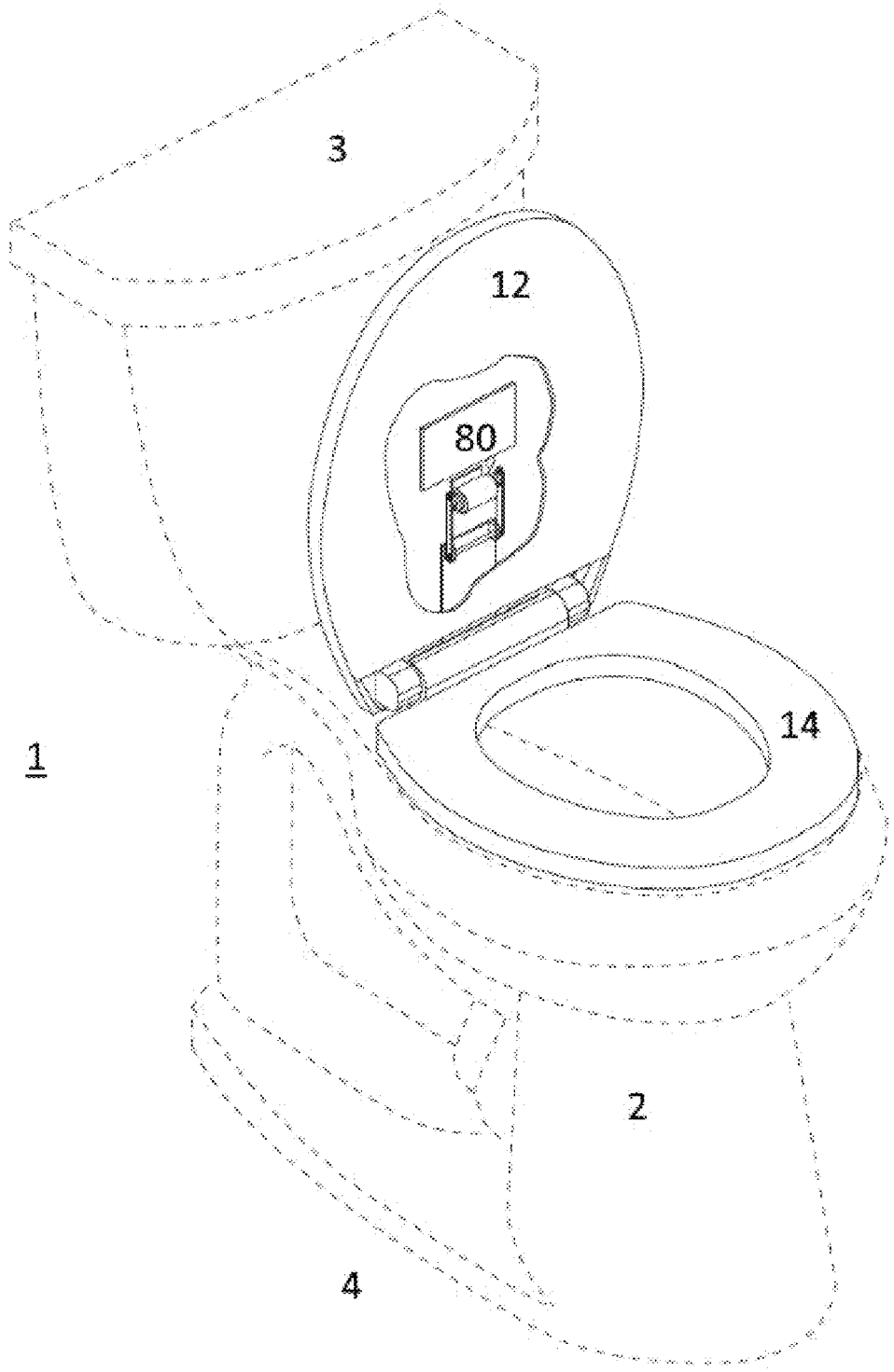
FIG. 1 is a perspective view of the toilet with a cutout of the lid exposing internal components of the lid according to one or more embodiments of the presently disclosed subject matter.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although the term "step" may be expressly used or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

FIG. 1 depicts a toilet 1 having a bowl 2 mounted to a surface 4. The toilet 1 may also include a base 16 coupled to a rear and upper portion of the bowl 2, wherein the base 16 can include and/or house a hinge 26 pivotably coupled with a lid 12 and/or a seat 14. The lid 12 and/or the seat 14 may be pivotable about the hinge 26 between a vertical position P1 and a horizontal position P2 for opening and closing the toilet 1 and exposing the bowl 2 for use. In some embodiments of the toilet 1, a lid 12 may not be included. When the toilet 1 is closed, the seat 14 and/or lid 12 rests in a horizontal position P2 relative to the surface 4 on which the toilet 1 is mounted or resting. When the toilet is open, the seat 14 and/or lid may rest in a vertical position P1 (or substantially vertical position P1—in some embodiments the vertical position P1 may be obtuse in relation to the surface 4) relative to the surface 4 on which the toilet 1 is mounted or resting. In some embodiments, the toilet 1 may include a tank 3 onto which the lid 12 and/or seat 14 rests in the vertical position P1.

FIG. 1 further illustrates internal components of the lid 12 by depicting a cutout of the lid 12, thereby exposing components of the system 10 for closing the toilet 1. The system 10 may include the lid 12, the seat 14, and the base 16 housing the hinge 26. The base 16 maybe configured to couple or fit to a standard toilet 1; the base 16 may include industry standards and specifications for easy installation or retrofitting to the toilet 1 by a user. The seat 14 may define a rear edge 22 positioned proximal to the base 16 and to a back edge 24 defined by the lid 16. The seat 14 and/or the lid 12 may be pivotable about the hinge 26 between the vertical position P1 and the horizontal position P2. Notably, as the rear edge 22 and/or back edge 24 pivots from the vertical position P1 to the horizontal position P2, the edges 22, 24 move up and away from the bowl 2 of the toilet 1.

Further, the system 10 may include an actuator 34 positioned within the lid 12 for translating an engaging portion 40 of an arm 36 into engagement with the rear edge 22 of the seat 14, thereby pivoting the seat 14 about the hinge 26 towards the horizontal position P2. The actuator 34 may be mounted into position within the lid 12. The actuator may be engaged with the arm 36 for translating the arm 36 substantially linearly and substantially parallel to the lid 12. The actuator 34 may include any combination of gears, struts, springs, or any other mechanical components capable of translating the arm 36. The arm 36 may extend from the lid 12 and define an engaging portion 40 positioned at an angle relative to the linear portion 41 of the arm 36. The angle may be perpendicular. The engaging portion 40 may be positioned proximal the base 16 and may rest perpendicularly thereto when the lid 12 is in the vertical position P1. The pivoting of the seat 14 is described in more detail infra.

The system 10 may also include detectors and sensors for making determinations about the positions of various components of the system 10, as well as for determining whether the system 10 is in use. An electronics housing 80 may be located within the lid for carrying many of the electronic components of the system 10, including electronic components that may support and include the sensors and/or detectors described herein, as well as supplemental processors, memory, receivers and transceivers. For example, a position detector 30 may be housed within the lid 12 for detecting when the seat 14, when the lid 12, or when both are in the vertical position P1, horizontal position P2, and/or a position between the vertical position P1 and the horizontal position P2. The position detector 30 may include one or several sensors for detecting positions. Using the detected information, the position detector 30 may inform the system 10 as to whether the actuator 34 should be activated to pivot the seat 14 and/or lid 12 from a vertical position P1 towards a horizontal, closed position P2. In one embodiment, the position detector 30 may include a lid tilt sensor for determining the position of the lid 12. For example, the lid tilt sensor may determine when the lid 12 is in the vertical position P1 or the horizontal position P2. In another embodiment, the position detector 30 may include both a lid tilt sensor and a seat sensor for determining when the seat 14 is substantially parallel with the lid 12. Alternatively, the position detector 30 may include a seat sensor for determining when the seat 14 is in the vertical position P1 or the horizontal position P2.

Figure 2:
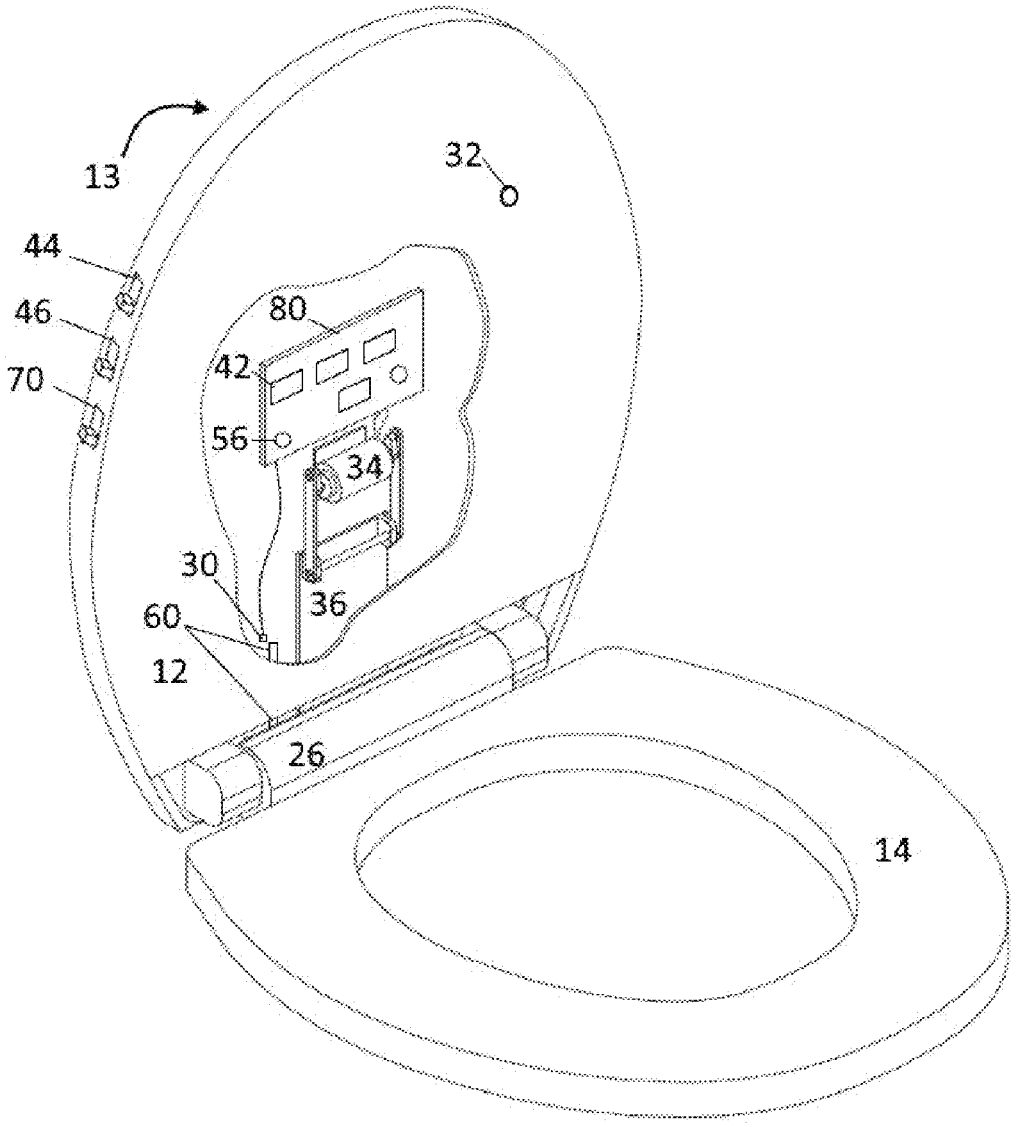
FIG. 2 is a perspective view of the lid in a vertical position and the seat in a horizontal position according to one or more embodiments of the presently disclosed subject matter.

The position detectors 30 may include any combination of an optical sensor, electromechanical sensor, capacitive sensor, inductive sensor, magnetic sensor or any other sensor for detecting a property. For example, the position detector 30 may include an optical distance seat sensor for sensing when the lid 12 and the seat 14 are substantially parallel by measuring the distance between the lid 12 and the seat 14. The seat sensor may be configured to detect when the seat 14 is in a vertical position by sensing when the rear edge of the seat 22 is positioned proximal to the engaging portion 40 of the arm. Alternatively the position detector 30 may include a magnetic seat sensor for detecting when a seat lever 60 (or second arm 36) is translated by the pivoting of the seat 14 to the vertical position P1, thereby triggering a sensation in the seat sensor (FIG. 2 depicts a seat lever 60 being detected by seat sensor position detector 30). The seat lever 60 may be spring-loaded. The position detector 30 may include the seat sensor, distance sensor, lid tilt sensor, and/or other sensors for determining the position of the lid 12 and/or seat 14.

Further, the system 10 may include a use detector 32 housed within the lid 12 for determining when the toilet 1 is not in use (FIG. 2). Similar to the position detector 30, the use detector 32 may include any combination of an optical sensor, electromechanical sensor, capacitive sensor, inductive sensor, magnetic sensor or any other sensor for detecting a property. For example, the use detector 32 may include the seat sensor for detecting when the seat 14 is placed into a vertical position P1, a presence sensor for detecting the presence of a toilet user (FIG. 2), a timer 56 for counting down a specified amount of time from detection of a vertical position P1 of the seat or a presence of a user, or any combination of these sensors or timers 56. Activation of the timing countdown by the timer 56 may be initiated by the use detector 32, the position detector 30, and/or any component of the position detector 30 and/or use detector. For example, the presence detector 30 may include a distance sensor for detecting when there is a presence located within a certain distance of the toilet 1 (e.g., a toilet user within three feet of the underside of the lid 12 when in the vertical position P1). In another embodiment, the use detector 32 may include a sensor for detecting when a user is sitting on the seat 14 of the toilet 1.

Figure 3A:
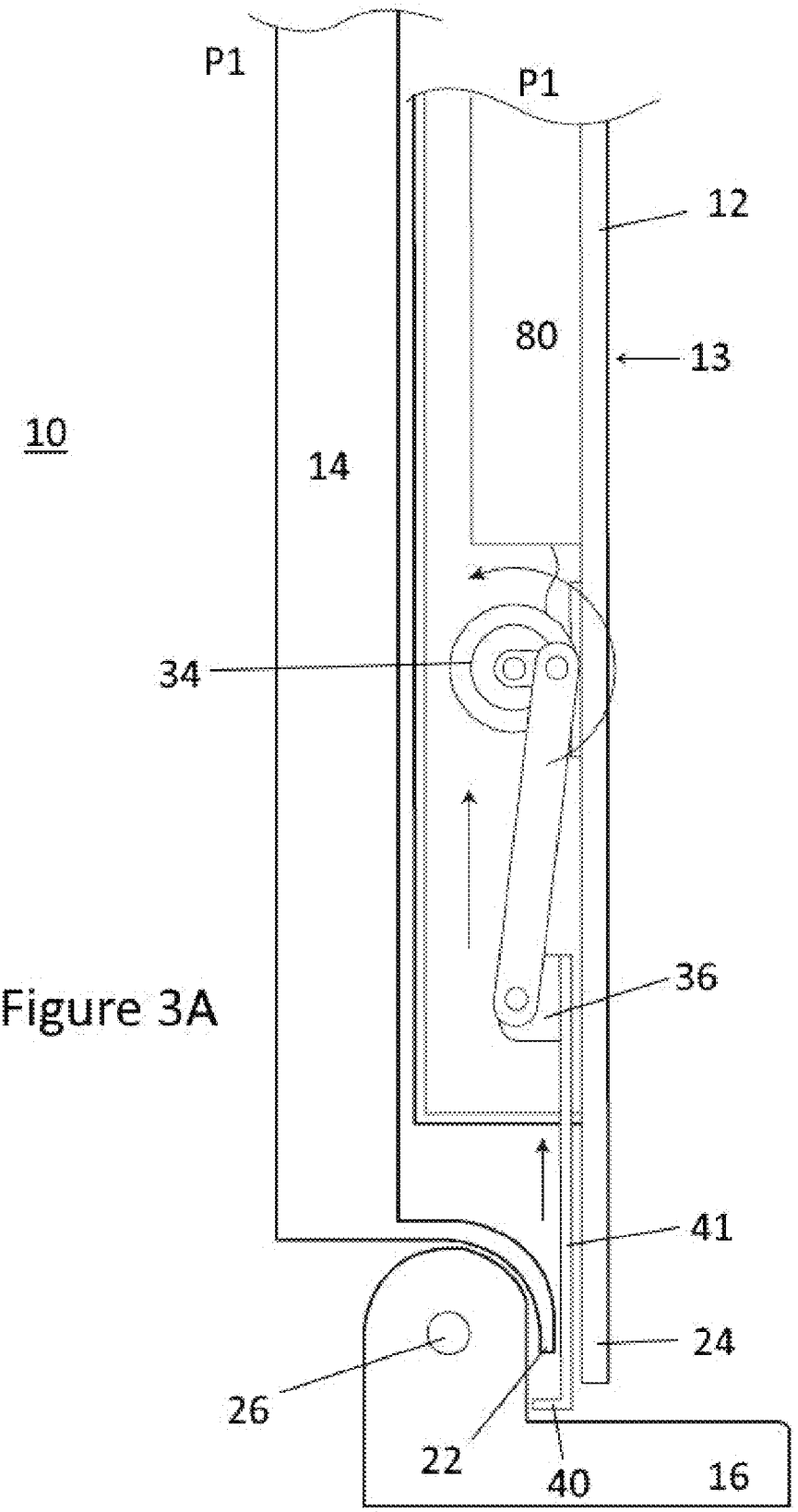
FIGS. 3A-3E are side views of the toilet depicting the movements of the arm when pivoting the seat and lid about the hinge according to one or more embodiments of the presently disclosed subject matter.
Figure 3B:
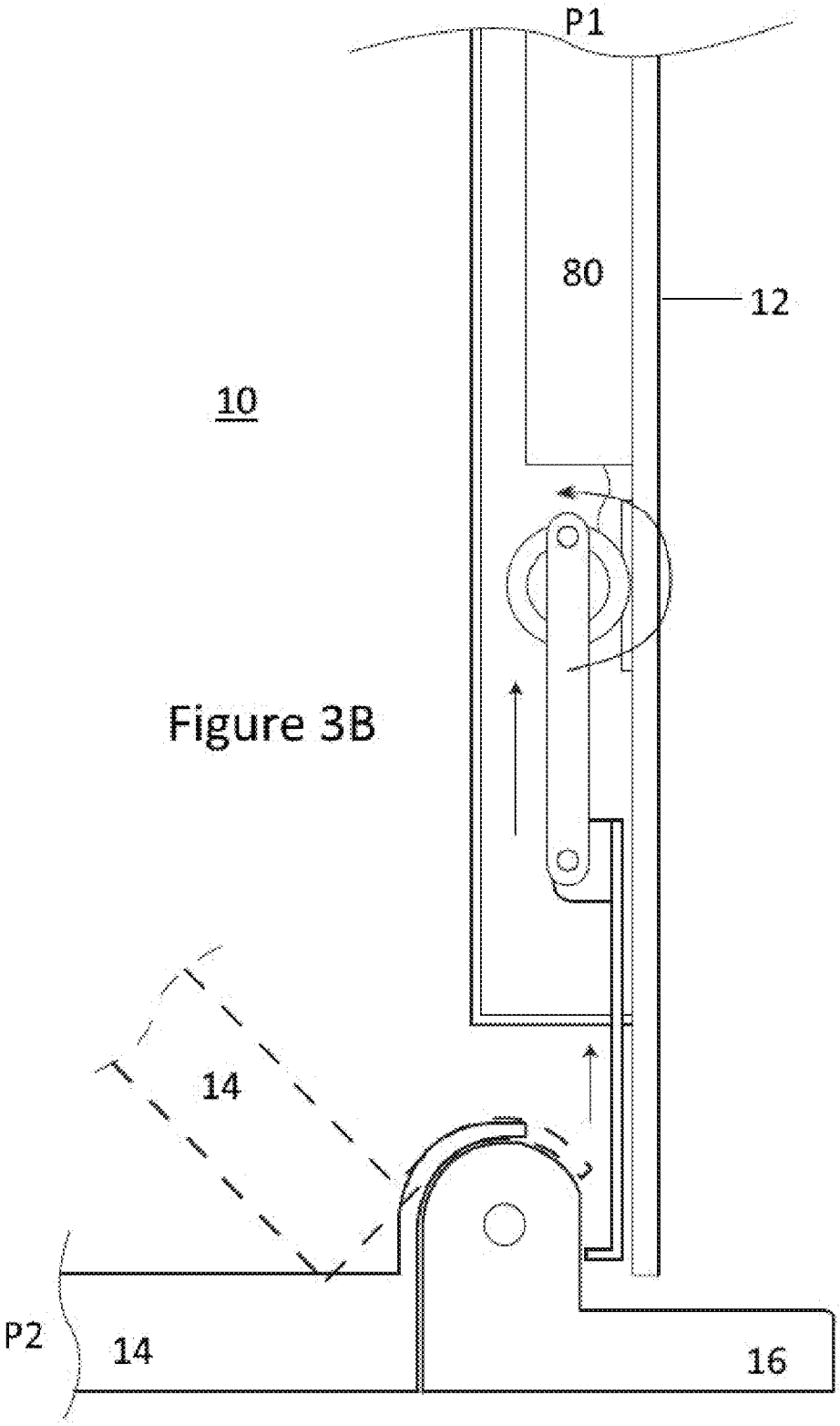
Figure 3C:
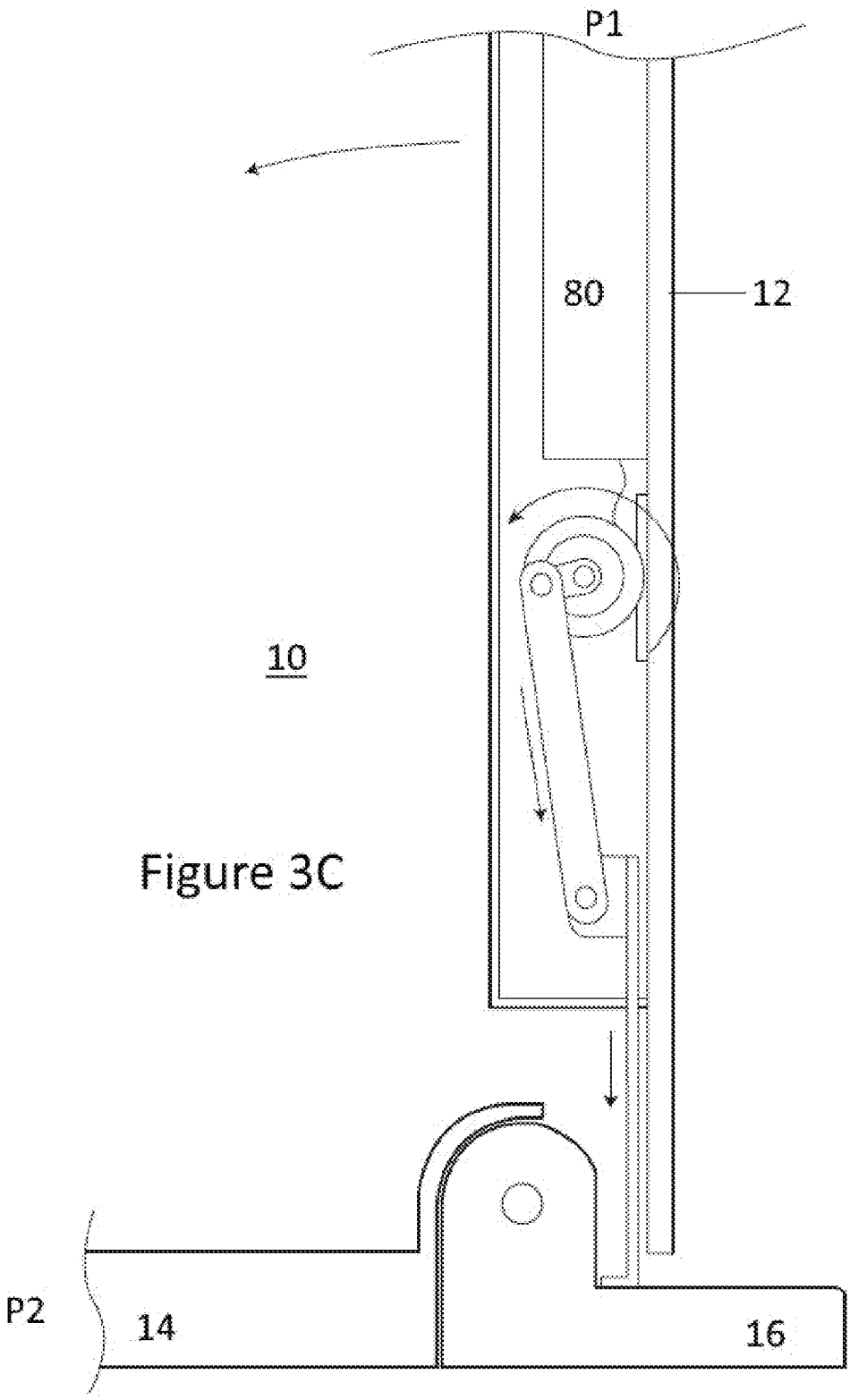
Figure 3D:
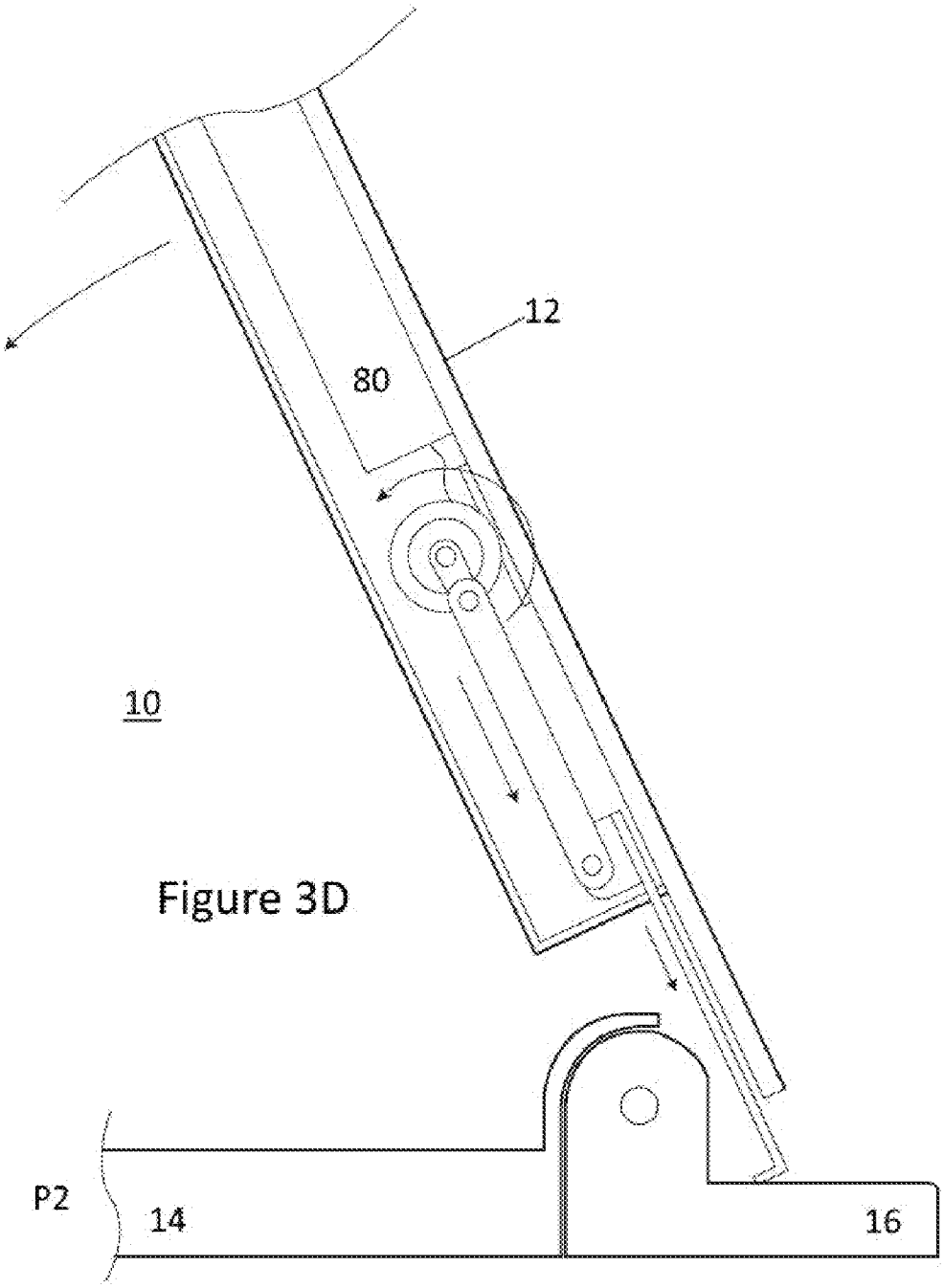
Figure 3E:
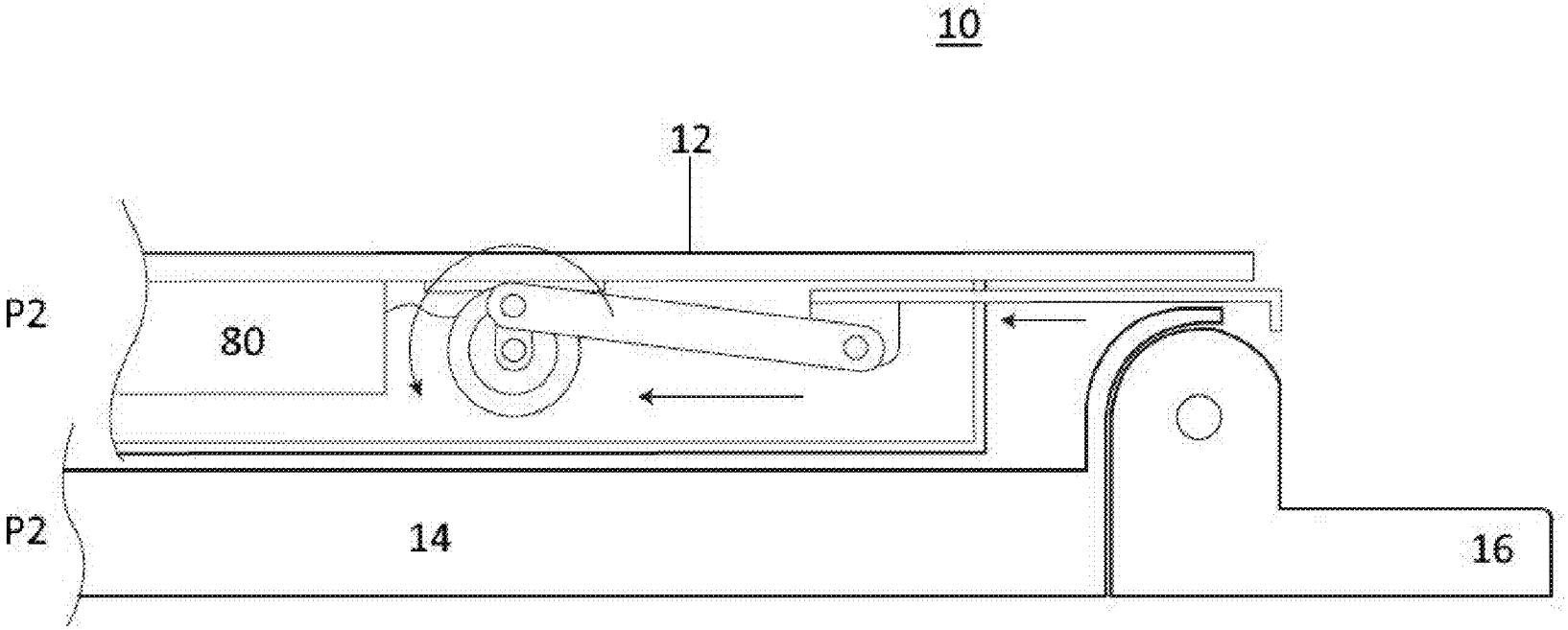
Figure 4A:
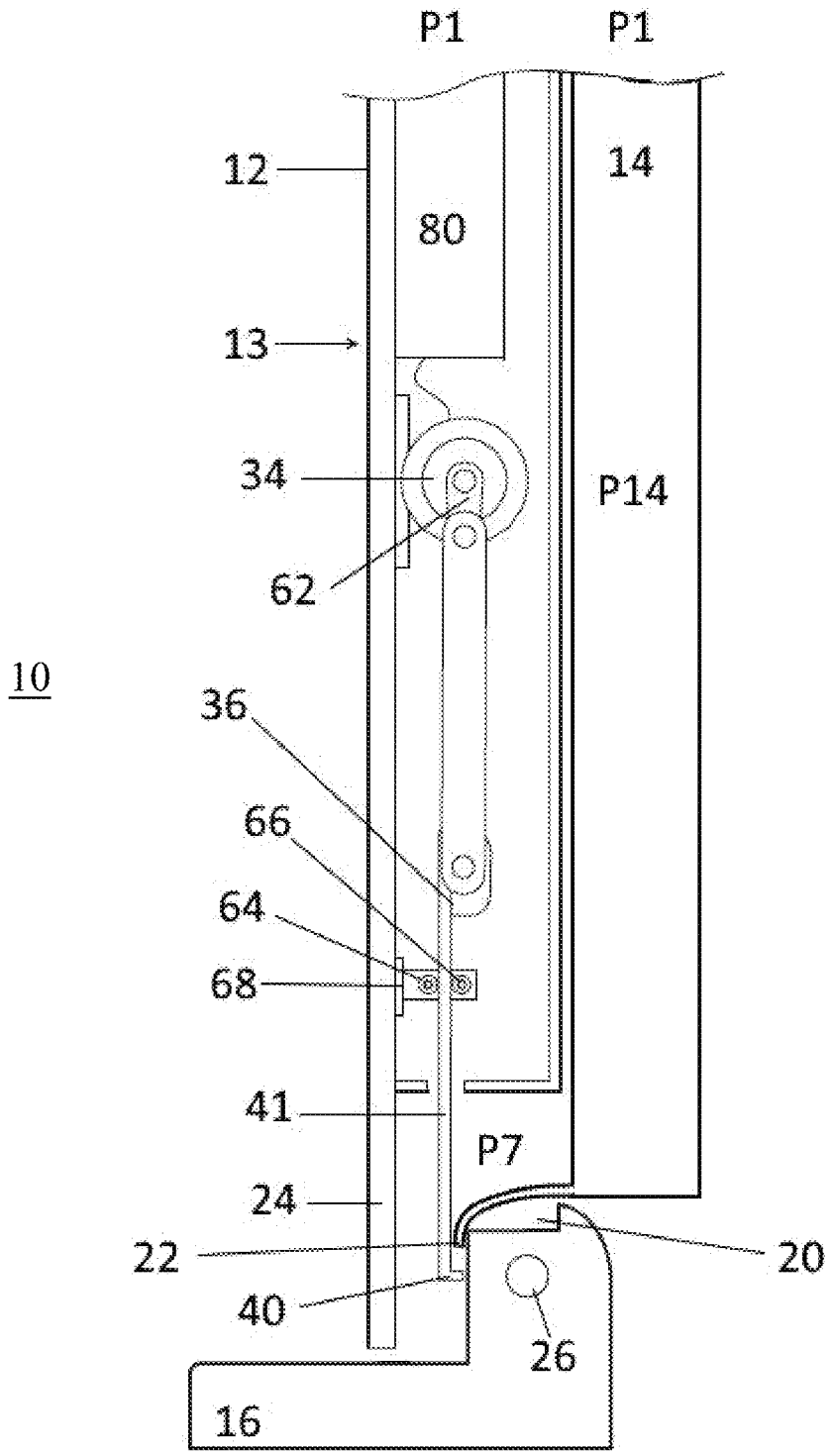
FIGS. 4A-4E are side views of an opposing side of the toilet depicting the movements of the arm engaged with a crank, pivot feature and stabilizing feature according to one or more embodiments of the presently disclosed subject matter.

The base 16 of the system 10 may define a ridge 20 for engaging the arm 36 during translation (FIG. 4A). In alternative embodiments, the arm 36 and/or engaging portion 40 may engage the base 16, bowl 2 or tank 3 in lieu of the ridge 20, as described herein (see FIG. 3D). The translation of the arm 36 may involve translating the engaging portion 40 upwards and above the ridge 20. Further, the translation of the arm 36 may further include the engaging portion 40 being translated downward, back toward the ridge 20, thereby engaging the ridge 20 and the engaging portion 40, causing the lid 12 to pivot from the vertical position P1 towards the horizontal position P2. The ridge 20 may be a lip or a groove defined by the base 16 and may extend horizontally across only a small portion of the base 16 or substantially across the entire base 16 or across a portion between the edges of the base 16. The ridge 20, or a portion thereof, may be reinforced by a coating or plating or be comprised of a material differing from the material of the base 16 for minimizing the wear and tear to the ridge 20 over time.

In an alternative embodiment, the ridge 20 may not be defined by the base 16 but instead be a component engaged with the base 16. For example, the ridge 20 may operate as a spring-loaded depressible feature so that the ridge 20 slides at least partially within the base 16 as the engaging portion 40 translates upward and past the ridge 20, extends back outward when the engaging portion 40 is positioned above the ridge 20, then remains affixed into position as the engaging portion 40 engages the ridge 20 to pivot the seat 14 and/or lid 12. In some embodiments, two actuators 34 and arms 36 having an engaging portion 40 are provided such that the pivoting of the seat 14 and the lid 12 are operated in mechanical independence; any mention of actuator 34 or arm 36 herein may include one or more actuators 34 or arms 36. The pivoting of the lid 12 and translation of the arm is described in more detail infra.

The system 10 may further include a power source 42 housed within the lid 12 for providing power to the actuator 34, the position detector 30, the use detector 32, and/or any other component of the system 10 requiring power. The power source 42 may include, for example, any combination of the following: batteries, rechargeable batteries, a toilet power source, or wind up power source. A power switch 44 may be included with the system 10 and positioned on the toilet 1, a component thereof, or may be remotely located and in wireless communication with the components of the system 10 housed within the lid 12. The power switch 44 may enable the power source 42 to provide power when the power switch 44 is in an automatic position. For example, the power switch 44 may be positioned remotely near a bathroom light switch or flush handle on the tank 3 or may be positioned on the lid 12 itself, whether on an exposed side of the lid 12 when in a horizontal, closed position or on an outside edge of the lid 12. Similarly, the power source 42 may be disabled to provide power when the power switch 44 is in a manual position, thereby permitting the toilet 1, lid 12 and/or seat 14 to be used in its normal manner as opposed to the automatic manner involving the system 10 described herein.

For toilets including both a lid 12 and a seat 14, a component switch 46 may be included in the system 10. Similar to the power switch 44, the component switch 46 may be positioned on the toilet 1, a component thereof, or may be remotely located and in wireless communication with the components of the system 10 housed within the lid 12 for controlling the translation of the arm(s) 36. In one embodiment, when the component switch 46 is in a seat position, the engaging portion 40 of the arm 36 is prevented from translating above the ridge 20, or prevented from engaging the ridge 20, so that the lid 12 is not closed during translation. Alternatively, when the component switch 46 is in a seat position, an actuator 34 associated with the lid 12 is disabled and only the actuator 34 associated with the seat 14 is enabled. In another embodiment, when the component switch 46 is in a lid position, the engaging portion 40 of the arm is enabled to be translated above the ridge 20 for permitting the lid 12 to be closed during translation of the arm 36. Alternatively, when the component switch 46 is in the lid position, the actuator 34 associated with the lid 12 is enabled along with the actuator 34 associated with the seat 14.

The system 10 may further include a sensor switch 70 positioned on the toilet 1, a component thereof, or may be remotely located and in wireless communication with the components of the system 10 housed within the lid 12. The sensor switch 70 may enable the operation of a use detector 32 without a timer 56 when in the use position or a use detector 32 with a timer 56 when in the other position. For example, when in the other position, the timer 56 alone may be used to determine when the seat 14 and/or lid 12 may be pivoted or, alternatively, the use detector 32 may first detect when the toilet 1 is not in use and then may activate the timer 56 of the use detector 32 to determine when the seat 14 and/or lid 12 may be pivoted.

Wireless communications may include any wireless signals disclosed in the prior art, including but not limited to near field communication, Bluetooth, radio signals, Wi-Fi and cellular signals. Further, the switches 44, 46, 70 may be remotely located within a software or application for use on a phone, tablet, computer or other computing device. A user may use the software or application to alter the positions of the switches 44, 46, 70. Further, the software or application may receive information concerning the power source 42 for alerting a user as to when the power source 42 needs to be replaced or recharged. Other issues, malfunctions or aberrations in the operation of the system 10 may also be detected using at least one of the detectors 30, 32 and/or sensors and reported wirelessly to the software or application for analysis and additional reporting to the user. Additionally, the software or application may be used to remotely pivot the seat 14 and/or lid 12 using the actuator 34 and arm 36.

FIGS. 3A-3E depict the translation of the engaging portion 40 of the arm 36 by the actuator 34 when pivoting the seat 14 about the hinge 26 according to one or more embodiments of the presently disclosed subject matter. The method for closing a toilet 1 by closing the seat 14 and/or lid 12 may include providing any embodiment of the system 10 and/or toilet 1 described herein. The method of automatically closing the seat 14 of the toilet 1 may include any combination of the following: the power switch 44 rests or is confirmed to be in an automatic position, the component switch 46 rests or is confirmed to be in the seat position or the lid position, the position detector 30 detects the seat 14 in a vertical position P1, or a use detector 32 determines the toilet 1 is not in use.

Once one, some, or all of these conditions are met, the actuator 34 may translate the engaging portion 40 from a vertical home position P7 proximal a lower portion of the base 16 upward along the base 16 into engagement with a rear edge 22 of the seat 14 for lifting the edge 22 and pivoting the seat 14 about the hinge 26 towards the horizontal position P2. Referring to FIGS. 4A-4E, in some embodiments, the translation of the engaging portion 40 of the arm 36 may continue to a seat top position P8. In other embodiments, the translation of the engaging portion 40 may continue to a lid top position P9 for allowing pivoting of the lid 12, as described infra. In either embodiment, the arm 36 may pivot the seat 14 at least partially towards the horizontal position P2, permitting gravity to pivot the seat 14 the remaining distance to the horizontal position P2. Alternatively, in either embodiment, the arm 36 may fully pivot the seat 14 into the horizontal position P2. Following the pivot of the seat 14 towards the horizontal position P2, the translation of the engaging portion 40 may continue, returning the engaging portion 40 to the vertical home position P7.

FIGS. 3A-4E illustrate the translation of the engaging portion 40 of the arm 36 by the actuator 34 when pivoting the lid 12 and/or seat 14 about the hinge 26 according to several embodiments of the presently disclosed subject matter. The method for closing a toilet 1 by closing the seat 14 and/or lid 12 may include providing any embodiment of the system 10 and/or toilet 1 described herein. The method of automatically closing the lid 12 of the toilet 1 may include any combination of the following: the power switch 44 rests or is confirmed to be in an automatic position, the component switch 46 rests or is confirmed to be in the lid position, the position detector 30 detects the seat 14 and/or lid in a vertical position P1, or a use detector 32 determines the toilet 1 is not in use.

Once one, some or all of these conditions are met, the actuator 34 may translate the engaging portion 40 from a vertical home position P7 proximal a lower portion of the base 16 upward along the base towards a lid top position P9. The lid top position P9 may be located above the seat top position P8 and above the ridge 20. The translation of the engaging portion 40 may continue and further include translating the engaging portion 40 from the lid top position P9 to a ridge position P10, thereby translating the engaging portion 40 into engagement with the ridge 20 for pivoting the lid from the vertical position P1 towards the horizontal position P2. Notably, the seat 14 may be pivoted towards the horizontal position P2 by pivoting the lid 12 or by translating the engaging portion 40 towards the lid top position P9 or both. The arm 36 may pivot the lid 12 at least partially towards the horizontal position P2, permitting gravity to pivot the lid 12 the remaining distance to the horizontal position P2.

The translation of the engaging portion 40 may further include translating the engaging portion 40 from the ridge position P10 to a horizontal home position P11. As the lid 12 moves towards and into the horizontal position P2, the translation may include translating the engaging portion 40 away from the lid 12 to the horizontal home position P11. If the lid 12 is pivoted from the horizontal position P2 to the vertical position P1, the engaging portion 40 is thereby pivoted from the horizontal home position P11 to the vertical home position P7, and therefore is positioned for translation for pivoting the seat 14 and/or lid 12.

FIGS. 4A-4E illustrate the translation of the engaging portion 40 of an arm 36 engaged with a crank 62 according to one or more embodiments of the present invention. The actuator 34 within the lid 12 of the toilet 1 may be engaged with one or more cranks 62 for rotatingly translating the arm 36. Rotating translation of the arm 36 may be preferable due to the 'figure eight' like motion the engaging portion 40 of the arm 36 makes, which permits the seat 14 to be pivoted from the vertical P1 to the horizontal position P2 without engaging the base 16 or ridge 20 and therefore contributing to wear and tear. A crank (or cranks) 62 may be positioned between, and engaged with, the actuator 34 and the arm 36 and rotatable in a complete or partial circle, in one or both directions. In some embodiments of the methods of use, the crank(s) 62 may be rotated in one direction in less than a complete circle, then rotated in the opposite direction back to the starting position of the crank(s) 62 for pivoting the seat 14 without engaging the lid 12. In other embodiments, the crank(s) 62 may be rotated in one direction in a complete circle back to the starting position for pivoting both the seat 14 and the lid 12 independently, as described more fully infra.

The embodiments of the arm 36 depicted in FIGS. 4A-4E are rotatably translated using a crank 62 between a pivot feature 64 and a stabilizing feature 66 which are secured into position using a catch 68 on each end of the features 64, 66. The features 64, 66 may be cylindrical in shape and freely rotatable for minimizing any friction placed on the arm 36. The features 64, 66 may stabilize the arm 36 during translation and serve to take load off the arm 36 during translation. The catch(es) 68 may define apertures for accepting the features 64, 66 therethrough. The catch(es) 68 may be affixed to the lid 12 for stabilization. In some embodiments, a pivot feature 64 may be used without the stabilizing feature 66. The pivot feature may be a ridge, multiple features positioned proximally to each other, or any other element for altering the translating motion of the arm 36.

Figure 4B:
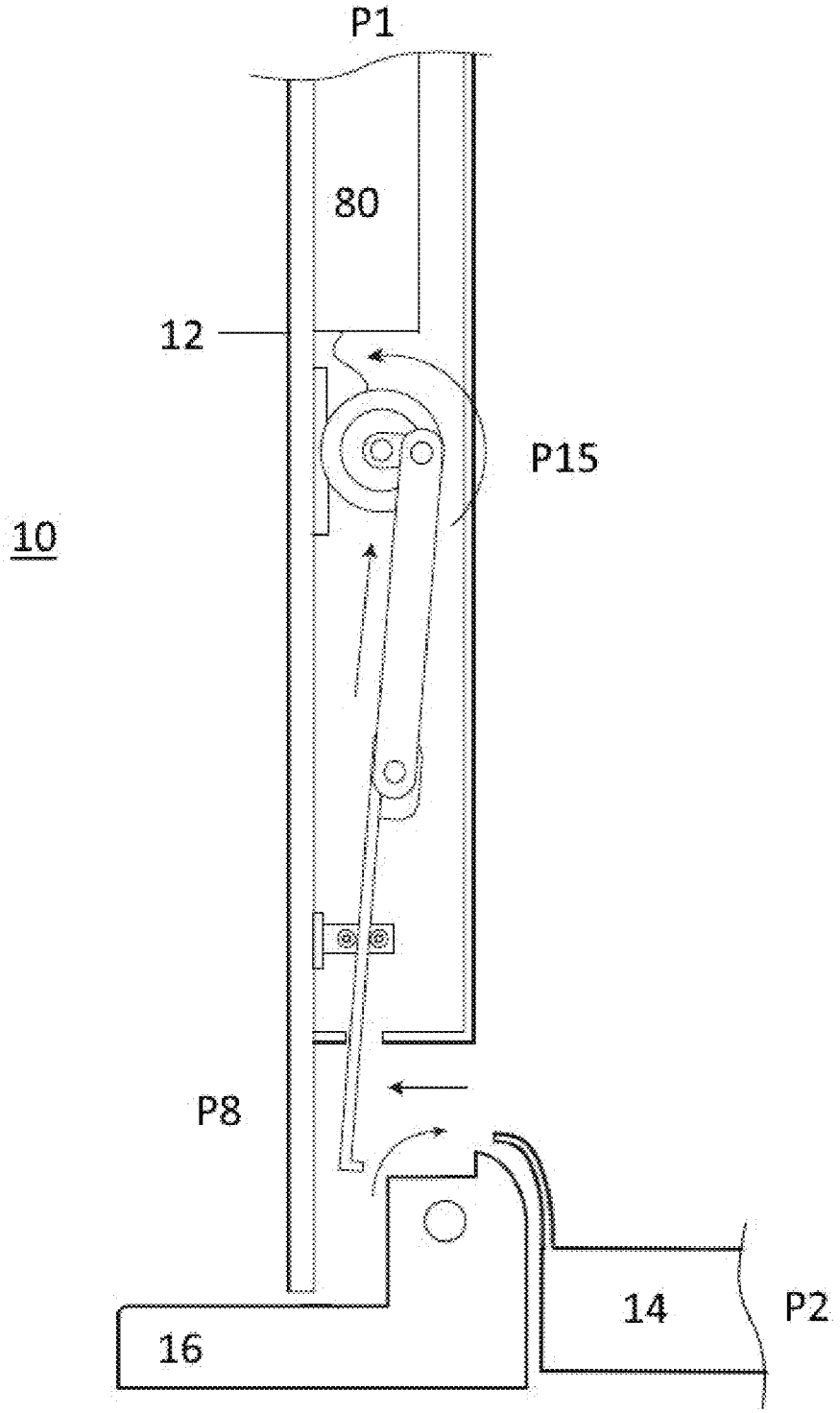
Figure 4C:
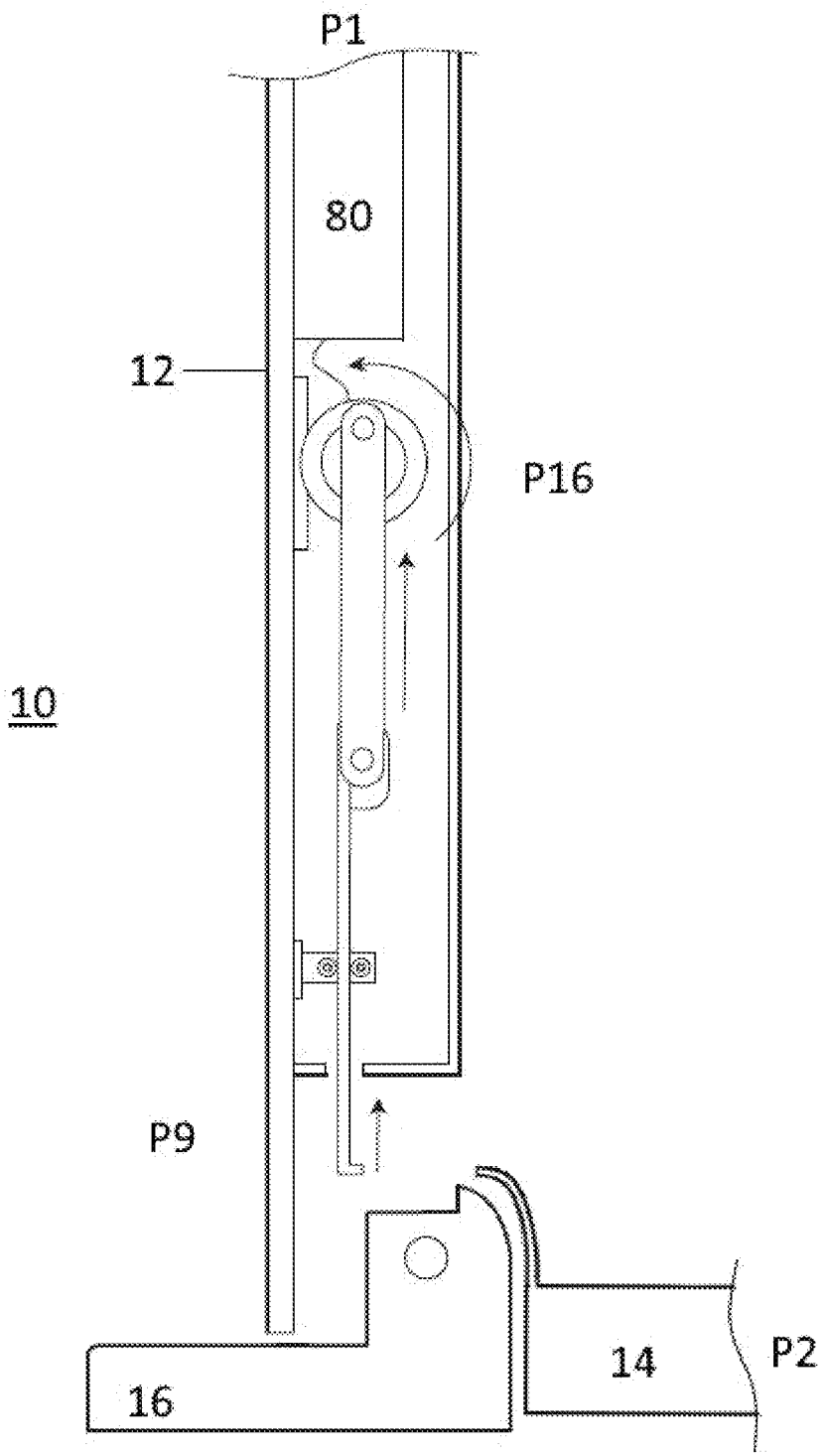
Figure 4D:
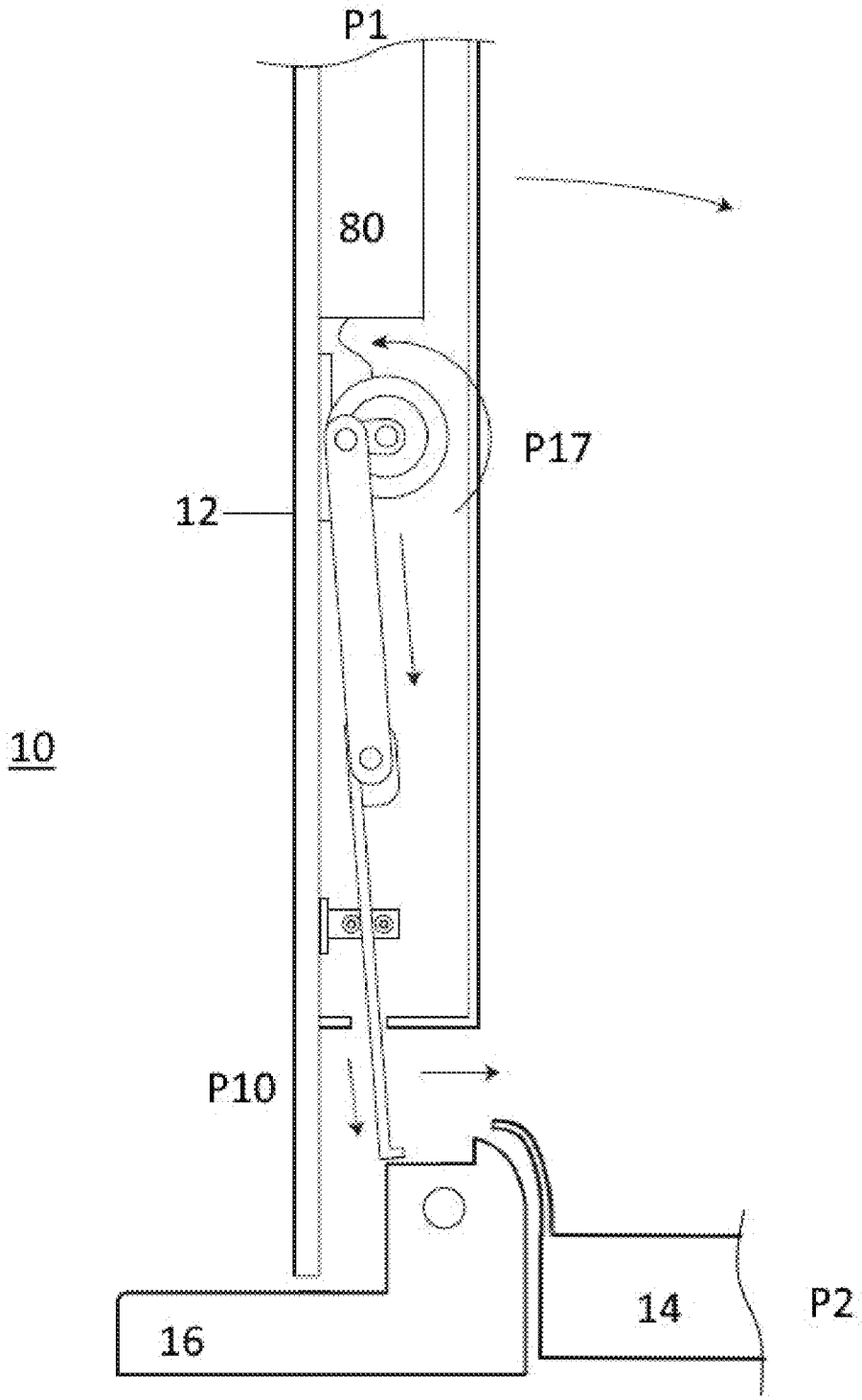

In one embodiment of the invention, as depicted in FIGS. 4A-4E, the crank 62 may rotate in a circular pattern for rotating the engaging portion 40 of the arm 36. The crank 62 and arm 36 may rest in the home position P14 (FIG. 4A). In the home position P14, the crank 62 may be fully extended towards the features 64, 66 and the arm 36 may be resting substantially parallel to the lid 12. As the crank 62 is rotated away from the features 64, 66 and away from the top 13 of the lid 12, the arm 36 pivots about the pivot feature 64, thereby pivoting the engaging portion 40 towards the top 13 of the lid 12 as the linear portion 41 translates towards the actuator 34 along with the movement of the crank 62, into the second position P15 (FIG. 4B). In the second position P15, the arm 36 is now positioned to engage the seat 14 while minimizing or avoiding contact with the ridge 20 and/or base 16.

As the crank 62 continues its semi-circle rotation away from the features 64, 66 into the third position P16 (FIG. 4C), the arm 36 approaches a substantially parallel position relative to the top 13 of the lid 12 again, although the arm 36 has now been fully translated away from the home position P14 and towards the actuator 34. The movement from the home position P14 through the second position P15 and towards the third position P16 permits the engaging portion 40 of the arm 36 to pivot the seat 14 from the vertical position P1 towards the horizontal position P2. If the pivoting of the lid 12 is not desired, then the crank's movement can be reversed by the motor from the third position P16, back through the second position P15 and back into the home position P14, so that contact with the ridge 20 and/or base 16 is avoided. The crank 62 may be rotated in either a clockwise or counterclockwise manner and may perform a full rotation, half rotation, quarter rotation or any other degree of rotation; the crank 62 may reverse the manner of rotation at any point in its circular motion.

Figure 4E:
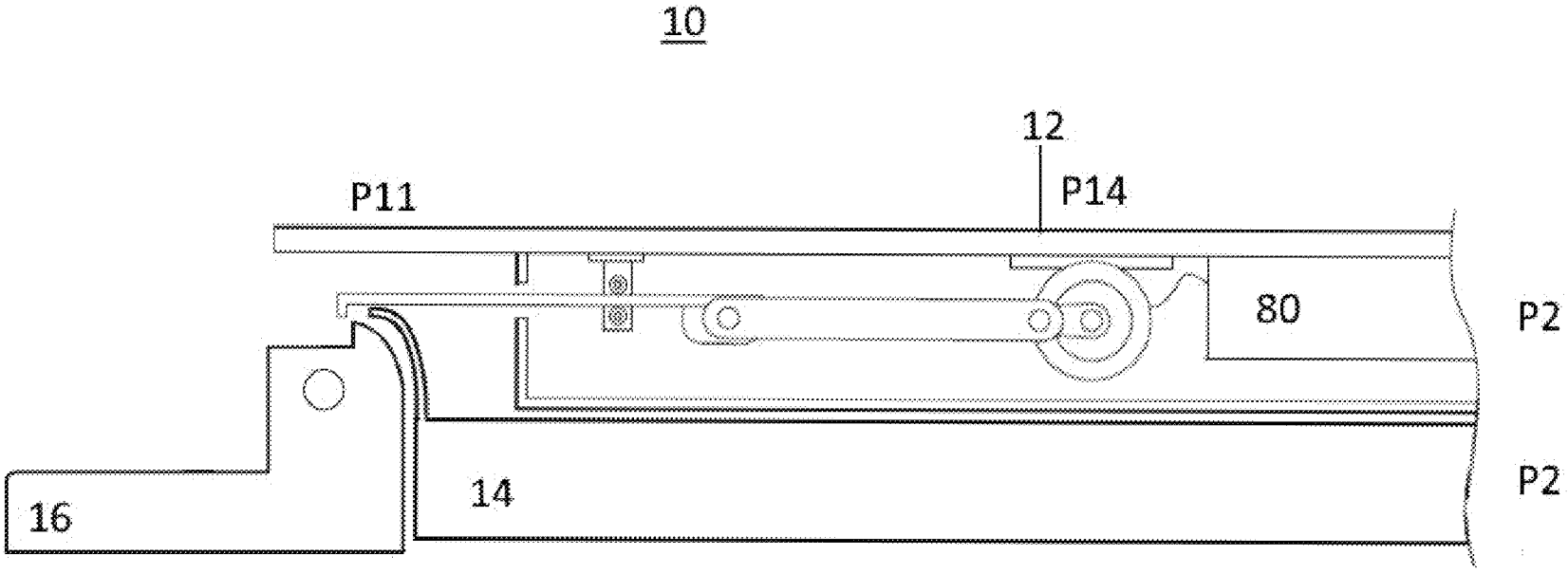

When pivoting of the lid 12 is also desired, the full circular rotation of the crank 62 may be performed by the actuator 34. Once in the third position P16, the crank 62 may continue to rotate, rotating back towards the features 64, 66 and towards the top 13 of the lid 12 into a fourth position P17 (FIG. 4D) opposite the second position P15. In the fourth position P17, the linear portion 41 of the arm 36 may extend from a position proximal to the top 13 of the lid 12, through the features 64, 66 and towards the engaging portion 40 now positioned distally from the top 13 of the lid 12. Because the engaging portion 40 is positioned distally from the top 13, in comparison to the proximal location when in the second position P15, the engaging portion 40 may engage the ridge 20 and/or base 16 for pivoting the lid 12. From the further position P17, the crank 62 may continue its rotation towards the home position P14 to rest (FIG. 4E).

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

The invention claimed is:

1. A method for closing a toilet, comprising:

a position detector housed within a lid detecting a seat in a vertical position, wherein the seat and the lid are pivotable between the vertical position and the horizontal position about a hinge housed within a base of the toilet;

a use detector housed within the lid determining the toilet is not in use;

when the seat is detected in the vertical position and the toilet is determined not in use, an actuator positioned within the lid translating an engaging portion of an arm into engagement with a rear edge of the seat for pivoting the seat about the hinge towards the horizontal position.

2. The method of claim 1, further comprising:

wherein the translation of the arm further involves translating the engaging portion above a ridge defined by the base of the toilet;

the actuator translating the engaging portion of the arm into engagement with the ridge for pivoting the lid from the vertical position towards the horizontal position.

3. The method of claim 1, further comprising a power source housed within the lid providing power to the actuator, the position detector and the use detector.

4. The method of claim 3, further comprising a power switch positioned on the toilet being placed in an automatic position for enabling the power source to provide power.

5. The method of claim 1, further comprising a component switch positioned on the toilet being placed in a seat position for controlling the translation of the arm to prevent the engaging portion from translating above a ridge defined by the base.

6. The method of claim 2, further comprising a component switch positioned on the toilet being placed in a lid position for controlling the translation of the arm to permit the engaging portion to translate above the ridge defined by the base.

7. The method of claim 1, wherein the position detector includes a lid tilt sensor determining when the lid is in the vertical position and a seat sensor determining when the seat is in the vertical position.

8. The method of claim 1, wherein the use detector includes a presence sensor detecting the presence of a toilet user or a timer or both.

9. The method of claim 8, wherein activation of the timer is initiated by the presence sensor or the position detector.

10. The method of claim 1, wherein:

the arm extends from the lid and the engaging portion is positioned proximal the base;

the pivoting the seat about the hinge only partially pivots the seat towards the horizontal position;

gravity completes the pivoting of the seat to the horizontal position.

11. A system for closing a toilet, comprising:

the toilet including a base housing a hinge, a lid, a seat defining a rear edge proximal to the base, wherein the seat and the lid are pivotable about the hinge between a vertical position and a horizontal position;

a position detector housed within the lid for detecting when the seat is in the vertical position;

a use detector housed within the lid for determining when the toilet is not in use;

an actuator positioned within the lid for translating an engaging portion of an arm into engagement with the rear edge of the seat for pivoting the seat about the hinge towards the horizontal position.

12. The system of claim 11, wherein:

the base defines a ridge;

the translation of the arm further involves translating the engaging portion above the ridge;

a translation of the arm further involves the engaging portion translating into engagement with the ridge for pivoting the lid from the vertical position towards the horizontal position.

13. The system of claim 11, further comprising a power source housed within the lid for providing power to the actuator, the position detector and the use detector.

14. The system of claim 13, further comprising a power switch positioned on the toilet for enabling the power source to provide power when the power switch is in an automatic position.

15. The system of claim 11, further comprising a component switch positioned on the toilet for controlling the translation of the arm such that the engaging portion does not translate above a ridge defined by the base when the component switch is in a seat position.

16. The system of claim 12, further comprising a component switch positioned on the toilet for controlling the translation of the arm such that the engaging portion translates above the ridge defined by the base when the component switch is in a lid position.

17. The system of claim 11, wherein the position detector includes a lid tilt sensor for determining when the lid is in the vertical position and a seat sensor for determining when the seat is in the vertical position.

18. The system of claim 11, wherein the use detector includes a presence sensor for detecting the presence of a toilet user or a timer or both.

19. The system of claim 18, wherein activation of the timer is initiated by the presence sensor or the position detector.

20. The system of claim 11, wherein:

the arm extends from the lid and the engaging portion is positioned proximal the base;

the pivoting the seat about the hinge only partially pivots the seat towards the horizontal position;

gravity completes the pivoting of the seat to the horizontal position.

* * * * *